US008827739B2

(12) United States Patent
Hanses

(10) Patent No.: US 8,827,739 B2
(45) Date of Patent: Sep. 9, 2014

(54) ELECTRIC CONNECTION TERMINAL

(75) Inventor: Markus Hanses, Höxter (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 92 days.

(21) Appl. No.: 13/581,180

(22) PCT Filed: Mar. 1, 2011

(86) PCT No.: PCT/EP2011/053019

§ 371 (c)(1),
(2), (4) Date: Nov. 6, 2012

(87) PCT Pub. No.: WO2011/107470

PCT Pub. Date: Sep. 9, 2011

(65) Prior Publication Data

US 2013/0052884 A1 Feb. 28, 2013

(30) Foreign Application Priority Data

Mar. 1, 2010 (DE) ..... 10 2010 009 804

(51) Int. Cl.
*H01R 4/26* (2006.01)
*H01R 4/48* (2006.01)
*H01R 9/26* (2006.01)

(52) U.S. Cl.
CPC ..... *H01R 9/2683* (2013.01); *H01R 4/4836* (2013.01)
USPC ..... 439/441; 439/488

(58) Field of Classification Search
USPC ..... 439/441, 488
See application file for complete search history.

(56) References Cited

U.S. PATENT DOCUMENTS

| | | | | |
|---|---|---|---|---|
| 5,810,625 | A * | 9/1998 | Klein et al. | 439/709 |
| 6,796,855 | B2 | 9/2004 | Fricke et al. | |
| 6,851,967 | B2 | 2/2005 | Miyoshi et al. | |
| 6,854,999 | B2 | 2/2005 | Patel et al. | |
| 7,090,530 | B1 * | 8/2006 | Dibble | 439/441 |
| 7,410,386 | B2 * | 8/2008 | Fabian et al. | 439/441 |
| 7,993,156 | B2 | 8/2011 | Holste | |

FOREIGN PATENT DOCUMENTS

| | | |
|---|---|---|
| DE | 10 2006 014646 | 10/2007 |
| EP | 1 309 036 | 5/2003 |
| EP | 1 353 407 | 10/2003 |
| EP | 1 383 203 | 1/2004 |
| JP | 2000-58155 | 2/2000 |
| JP | 2001-160431 | 6/2001 |
| JP | 2001-210393 | 8/2001 |
| JP | 2007-149476 | 6/2007 |

OTHER PUBLICATIONS

Notice of Reasons for Rejection dated Sep. 17, 2013 for Japanese Patent Application 2012-554371.
International Search Report for application PCT/EP2011/053019 mailed Apr. 29, 2011.

* cited by examiner

*Primary Examiner* — Gary Paumen
(74) *Attorney, Agent, or Firm* — Knobbe, Martens, Olson & Bear LLP

(57) ABSTRACT

An electrical terminal may include a terminal boot, a spring-force element disposed in the terminal boot, and an operating push-piece movably disposed in the terminal boot to operate the spring-force element. The operating push-piece may include, on a front surface, a labeling surface for marking the operating push-piece.

9 Claims, 2 Drawing Sheets

ELECTRIC CONNECTION TERMINAL

CROSS-REFERENCE TO RELATED APPLICATIONS

This application claims priority under 35 USC §119 to International Patent Application No. PCT/EP2011/053019, filed on Mar. 1, 2011 with the Patent Cooperation Treaty, which claims priority under 35 USC §119 to German Patent Application No. 10 2010 009 804.3, filed on Mar. 1, 2010 with the German Patent and Trademark Office, the contents are herein incorporated by reference in their entirety.

BACKGROUND

The invention concerns an electrical terminal with an operating push-piece.

Such electrical terminals usually include a terminal boot and a spring-force element disposed inside the terminal boot for clipping one of the conductors inserted into the terminal boot onto a contact surface provided inside the terminal boot. To exert a force on the spring-force element when inserting and/or removing the conductor from the terminal boot, an operating push-piece is usually movably disposed in the terminal boot.

In particular, if several terminals are disposed in a terminal arrangement, then it is preferred that marking or labeling of the terminals be provided, whereby these are accordingly identifiable and distinguishable from one another, for example in reference to their function. An appropriate fixture is usually provided for such labeling on the terminal boot of the terminals on which, for example, a label strip can be placed. Due to the additional provision of a fixture on the terminal boot, an additional structural space is needed on the terminal, as a result of which the dimensions of the terminal boot and thus of the electrical terminal are too large for certain applications.

BRIEF SUMMARY

The invention is hence based on the object of making an electrical terminal, which is distinguished by a reduced need for space, with marking or labeling on the terminal possible at the same time.

The approach to the object occurs according to the invention through the characteristics of claim 1. Advantageous embodiments of the invention are cited in the subclaims.

The electrical terminal according to the invention exhibits a terminal boot, in which an operating push-piece is movably disposed for operating a spring-force element disposed in the terminal boot, in which according to the invention the operating push-piece exhibits a labeling surface on the front surface for marking the operating push-piece.

The terminal according to the invention is distinguished in that no additional fixture is needed on the terminal boot for applying marking on the terminal, but the marking can be provided on a structural part already provided on an electrical terminal in the form of the operating push-piece, without additional space being needed for this. For this, the operating push-piece exhibits a labeling surface on a front surface, which points away from the terminal boot, on which marking, for example in the form of printing or labeling, for example by means of a laser or a pressure plug method, can be applied. By virtue of the fact that this occurs on a front surface of the operating push-piece, which is directed outward from the terminal boot, the marking is disposed on the outside, readily visible to a user. It is therefore possible to provide marking on a terminal with reduced need for space in the entire terminal.

According to a preferred embodiment of the invention, the front surface exhibits an operating surface for a tool, in which the operating surface is provided adjacent to the labeling surface. The operating surface is preferably constructed such that a tool, for example a screwdriver, can function at the operating surface to enable movement of the operating push-piece in a preferably axial direction upon the spring-force element against the spring force of the spring-force element. What is more, the front surface is preferably made up of the labeling surface and the operating surface, in which these two are disposed immediately adjacent to one another. Preferably, moreover, the labeling surface exhibits more than ⅔ and the operating surface less than ⅓ of the total surface area of the front surface. Thus an optimal, functional utilization of space is possible for the front side, visible from the outside, of the operating push-piece.

The operating surface is preferably constructed to be staggered to labeling surface. The operating surface is consequently preferably not disposed in the plane of the labeling surface. Preferably, then, the operating surface is disposed lower than the labeling surface or stepped to the labeling surface. By means of the staggered arrangement, an edge or a step is constructed between the operating surface and the labeling surface. The step or the edge can serve as a surface for bracing a tool on the operating surface, as a result of which slipping of the tool can be prevented upon operating the operating push-piece.

The operating surface further preferably exhibits a design angled obliquely in the direction of the labeling surface. This is especially preferred to be provided if the operating surface is disposed stepped to the labeling surface and a step or edge is thus formed between the operating surface and the labeling surface. Thus it is possible for a tool on the operating surface to be automatically guided in the direction of the step or edge, in order to be able to achieve especially secure bracing of the tool during the operating process of the operating push-piece and as a result, especially secure prevention enabling the tool to keep from slipping on the operating surface.

Furthermore, it is advantageously provided that the operating surface is constructed at a border area of the front surface. The operating surface is thereby preferably designed at the front surface such that the operating surface is flat and is immediately adjacent to the border area or the edge area of the front surface, so that only one step or edge is formed at the side edge of the operating surface, which is immediately adjacent to the labeling surface. It is, however, also possible that between the edge areas of the front surface, to which the operating surface is adjacent, a periphery of the operating surface is provided disposed as raised up to the operating surface, in which this periphery preferably exhibits at a maximum the height of the operating surface, so that the periphery does not rise above the operating surface.

In order to be able, for example, to apply marking to the operating surface if the operating push-piece has already been inserted into the terminal boot of the terminal, it is preferred to provide that the operating push-piece be inserted into the terminal boot flush with the operating surface. "Flush" here means that the labeling surface is disposed on the plane of the outer surface of the terminal boot and the labeling surface preferably does not rise above the terminal boot and consequently is constructed not to be higher than the outer surface of the terminal boot. It is thereby possible, for example, for a printing stamp to be able to be brought sufficiently close to the labeling surface to be able to apply qualitatively good marking or labeling to the labeling surface. What is more, it is further preferred to provide that the entire operating push-piece, and therewith any other additional surfaces provided on the operating push-piece as well, does not rise above the terminal boot, but is finished flush at least the outer surface of the terminal boot, so that it is possible to arrange an adaptor, for example, on the terminal boot or set one on the terminal boot.

Furthermore, the invention concerns a terminal arrangement with a boot, within which are disposed one or more electrical terminals, such as those currently constructed and developed.

Moreover, it is preferred to provide that the operating surface of the operating push-piece of electrical terminals be a shorter distance from the boot than the labeling surface. The operating surface is therewith preferably provided between the boot of the terminal arrangement and the labeling surface, so that the labeling surface is disposed at a border area of the terminal arrangement in order to ensure that the labeling surface is readily accessible, for example to a printing stamp, if the terminal together with the operating push-piece is already disposed in the boot of the terminal arrangement.

The invention is explained in detail hereinafter, using a preferred embodiment, with reference to the drawings attached.

DETAILED DESCRIPTION

Figure 1:
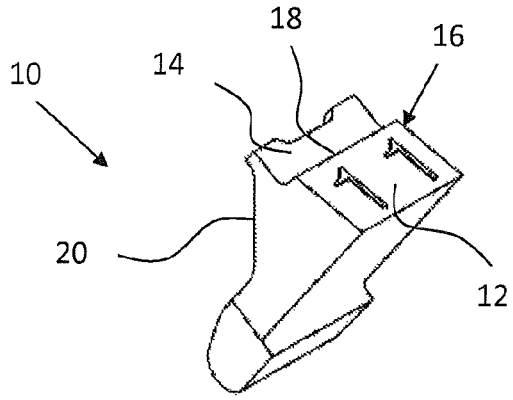
FIG. 1, a schematic representation of the operating push-piece according to the invention.

FIG. 1 shows a schematic representation of an operating push-piece 10 according to the invention, which exhibits a labeling surface 12 for marking the operating push-piece 10 and an operating surface 14 provided adjacent to the labeling surface 12 for operating the operating push-piece 10 with a tool. The labeling surface 12 and the operating surface 14 are provided on a front surface 16 of the operating push-piece 10, in which the labeling surface 12 preferably extends over more than ⅔ of the front surface 16 and the operating surface 14 over less than ⅓ of the front surface 16. The operating surface 14 and the labeling surface 12 are therewith preferably constructed to be right-angled. At the same time, the labeling surface 12 and the operating surface 14 immediately adjoin the border area or the edge area of the front surface 16.

As may be seen in FIG. 1, the operating surface 14 is staggered to the labeling surface 12, in which the operating surface 14 is disposed stepped to the labeling surface 16, so that a step or an edge 18 is formed between the operating surface 14 and the labeling surface 12, which can serve as a bracing surface for a tool on the operating surface 14. The operating surface 14 is therewith preferably designed obliquely angled in the direction of the labeling surface 12, so that the operating surface 14 exhibits an inclined rise in the direction of the labeling surface 12, in order to form as large a bracing surface as possible in the form of the step or edge 18.

The operating push-piece 10 further exhibits on the surface 20 opposite the front surface 16 an oblique shoulder, whereby as much material of the operating push-piece 10 as possible is provided below the labeling surface 12, in order to be able to attain high stability, especially for labeling the labeling surfaces 12.

Figure 2:
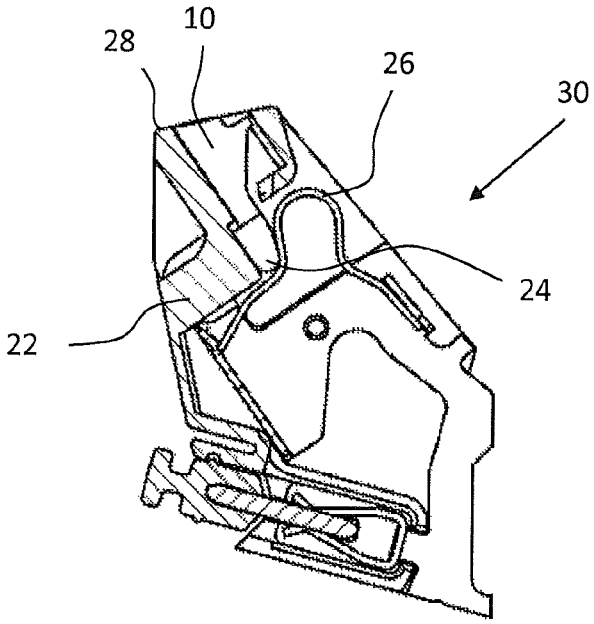
FIG. 2, a schematic representation of an electrical terminal with an operating push-piece disposed therein according to FIG. 1.

In FIG. 2, the operating push-piece 10 is shown according to the invention in a terminal boot 22 of an electrical terminal 30. At the same time, the operating push-piece 10 is, with its push-piece surface 24, adjacent to a spring-force element 26 constructed in the form of a spring leg, in which in FIG. 2 the operating push-piece 10 is shown in a non-operated state.

As is shown in FIG. 2, the operating push-piece 10 is disposed in the terminal boot 22 such that the labeling surface 12 is finished flush with the outer surface 28 of the terminal boot 22. The operating surface 14 is disposed inside the terminal boot 22, underneath the outer surface 28 of the terminal boot 22.

Figure 3:
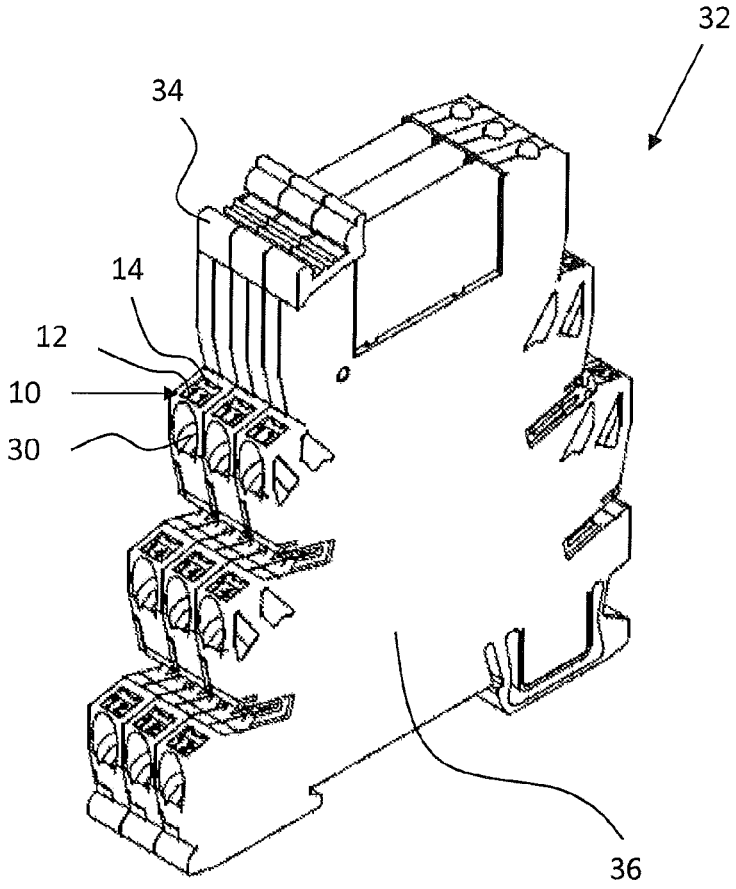
FIG. 3, a schematic representation of a terminal arrangement with several terminals disposed thereon according to FIG. 2.

FIG. 3 shows several of the electrical terminals 30 shown in FIG. 2, disposed in a terminal arrangement 32, in which the terminal arrangement exhibits a boot 36, inside which the terminals 30 can be arranged. In the inserted state of the terminals 30, together with the operating push-piece 10 in the boot 36 of the terminal arrangement 32, the operating surface of the operating push-piece 10 is a shorter distance from the boot 36 than the labeling surface 12, so that the operating surface 14 is disposed essentially between the labeling surface 12 and the boot 36.

The terminal arrangement 32 can at the same time be made up of a plurality of slice-like modules 34, which can be packed together one after the other on a support rail, not depicted here.

Reference List
Operating push-piece 10
Labeling surface 12
Operating surface 14
Front surface 16
Step or edge 18
Surface 20
Terminal boot 22
Push-piece surface 24
Spring-force element 26
Outer surface 28
Terminal 30
Terminal arrangement 32
Module 34
Boot 36

What is claimed is:

1. An electrical terminal, comprising:

a terminal boot;

a spring-force element disposed in the terminal boot; and an operating push-piece movably disposed in the terminal boot to operate the spring-force element, wherein the operating push-piece includes a front surface comprising:

a labeling surface for marking the operating push-piece, and an operating surface configured to receive a tool and located adjacent to the labeling surface, wherein the operating surface is angled obliquely relative to the labeling surface, wherein the operating push-piece is inserted into the terminal boot such that the labeling surface is flush with an outer surface of the terminal boot.

2. The electrical terminal according to claim 1, wherein the operating surface is staggered relative to the labeling surface.

3. The electrical terminal according to claim 1, wherein the operating surface is located at a border area of the front surface.

4. An electrical terminal arrangement, comprising:

a boot; and multiple electrical terminals, comprising:

a spring-force element disposed in the boot; and an operating push-piece movably disposed in the boot to operate the spring-force element, wherein the operating push-piece includes a front surface comprising:

a labeling surface for marking the operating push-piece, and an operating surface configured to receive a tool and located adjacent to the labeling surface, wherein the operating surface is angled obliquely relative to the labeling surface, wherein the operating push-piece is inserted into the terminal boot such that the labeling surface is flush with an outer surface of the terminal boot.

5. The terminal arrangement according to claim 4, wherein a distance from the operating surface of the operating push-piece of the electrical terminals to the boot is shorter than a distance from the labeling surface to the boot.

6. An electrical terminal, comprising:

a terminal boot;

a spring-force element disposed in the terminal boot; and an operating push-piece movably disposed in the terminal boot to operate the spring-force element, wherein the operating push-piece includes a from surface comprising:

a labeling surface for marking the operating push-piece, an operating surface configured to receive a tool and located adjacent to the labeling surface, wherein the operating surface is angle obliquely relative to the labeling surface, and a side surface between and connecting the operating surface and the labeling surface.

7. The electrical terminal according to claim 6, wherein the operating surface abuts the side surface to form a groove, wherein the operating surface is configured to receive the tool at an oblique angle and guide the tool towards an intersection formed by the side surface and the operating surface.

8. The electrical terminal according to claim 7, wherein the operating surface comprises a flat surface bounded by the intersection at a first side and an edge stepping downwards at a second side opposite the first side.

9. An electrical terminal arrangement, comprising:

a boot; and multiple electrical terminals, comprising:

a spring-force element disposed in the boot; and an operating push-piece movably disposed in the boot to operate the spring-force element, wherein the operating push-piece includes a front surface comprising:

a labeling surface for marking the operating push-piece, an operating surface configured to receive a tool and located adjacent to the labeling surface, wherein the operating surface is angled obliquely relative to the labeling surface, and a side surface between and connecting the operating surface and the labeling surface.

* * * * *

UNITED STATES PATENT AND TRADEMARK OFFICE

CERTIFICATE OF CORRECTION

PATENT NO. : 8,827,739 B2
APPLICATION NO. : 13/581180
DATED : September 9, 2014
INVENTOR(S) : Markus Hanses It is certified that error appears in the above-identified patent and that said Letters Patent is hereby corrected as shown below:

In the Claims

In column 5 at line 29, In Claim 6, change “from” to --front--.

In column 6 at line 4, In Claim 6, change “angle” to --angled--.

Signed and Sealed this
Nineteenth Day of May, 2015

Michelle K. Lee

Michelle K. Lee
*Director of the United States Patent and Trademark Office*